US006095056A

United States Patent [19]

Schumacher

[11] Patent Number: 6,095,056

[45] **Date of Patent: *Aug. 1, 2000**

[54] SCORING TABLE WITH INTEGRAL POSSESSION INDICATING SIGN

[76] Inventor: Larry Schumacher, 9435 Wright Ave., Machesney Park, Ill. 61115

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,247

[22] Filed: Dec. 2, 1996

[51] Int. Cl.[7] ..... A47B 85/00

[52] U.S. Cl. ..... 108/23; 108/115; 40/564

[58] Field of Search ..... 108/23, 115; 312/258, 312/262, 223.5; 40/564, 567, 729, 727; 340/815.74, 815.73; 273/237, 277, 309, 459, 460

[56] References Cited

U.S. PATENT DOCUMENTS

| | | | |
|---|---|---|---|
| 171,683 | 1/1876 | Miller | 312/258 X |
| 835,902 | 11/1906 | Damato . | |
| 1,113,263 | 10/1914 | Ulrich | 108/23 |
| 1,128,031 | 2/1915 | Needleman . | |
| 2,810,617 | 10/1957 | Slanhoff . | |
| 3,333,766 | 8/1967 | Crossland et al. . | |
| 3,345,760 | 10/1967 | Oystein . | |
| 3,361,090 | 1/1968 | Howlett . | |
| 3,850,114 | 11/1974 | Ganteaume . | |
| 4,189,197 | 2/1980 | Walker, Jr. . | |
| 4,223,945 | 9/1980 | Nikitits . | |
| 4,280,291 | 7/1981 | Maynes . | |
| 4,512,098 | 4/1985 | Ready et al. | 40/564 X |
| 4,519,318 | 5/1985 | Weldon-Ming . | |
| 4,579,401 | 4/1986 | Mears . | |
| 4,747,596 | 5/1988 | Harrison . | |
| 4,747,644 | 5/1988 | Gallery et al. . | |
| 4,751,506 | 6/1988 | Brown . | |
| 4,856,778 | 8/1989 | Harrison | 108/23 X |
| 5,405,192 | 4/1995 | McGrath . | |
| 5,542,554 | 8/1996 | Resnick | 312/223.5 X |
| 5,551,558 | 9/1996 | Bureau | 312/258 X |

OTHER PUBLICATIONS

Front Row Scoring Tables, News Release, Jun. 1996, 1 page.

*Primary Examiner*—José V. Chen
*Attorney, Agent, or Firm*—Keith Frantz

[57] ABSTRACT

A scoring table, for use at sporting events involving play between two teams and changing possession of a ball between the teams, includes a table top, support legs, a front section with an integral bi-directional indicating sign having oppositely directed horizontal arrows, and a manually operable switch for selectively illuminating the arrows so as to indicate possession of the ball during the course of the event.

20 Claims, 8 Drawing Sheets

SCORING TABLE WITH INTEGRAL POSSESSION INDICATING SIGN

BACKGROUND OF THE INVENTION

This invention relates generally to scoring tables adapted for use at sporting events. More particularly, the invention relates to a scoring table for use at events involving play between two teams and changing possession of a ball between the teams such as in a basketball game.

At such sporting events, a scoring table may be located to the side of the playing area (e.g., the basketball court) for use by game personnel such as a timekeeper, a scorer, and a statistician.

Scoring tables of this type typically include a horizontal table top to provide a working surface for the game personnel, a front section which generally closes off the front of the table, and legs and/or wheels for supporting the table.

The front, top, sides, and exposed edges and corners of the forward portion of the table are typically covered with relatively thick, vinyl-covered foam padding to protect the players from injury in the event that a player bumps, falls, or is pushed into the table.

During, for example, a high school basketball game, it is desirable to provide the game referees on the court with information as to possession of the ball. More specifically, it is desirable for personnel at the scoring table to indicate which team has possession of the ball at all times during the course of the game. This changing possession information is normally displayed with a so-called possession sign located at the scoring table.

A possession sign typically includes a front panel with translucent arrow heads or arrows pointing in opposite horizontal directions. The letters "POSS" or "POSSESSION" are visible on the panel between the oppositely pointing arrows. Such signs also include two electrical lights behind the panel, one being behind each arrow, a switch for manually illuminating either one or the other of the arrows, and the associated electrical fixtures and wiring. In this way, with the two teams sitting on opposite ends of the court, and with the scoring table located between the teams, the scorer, for example, can indicate the team with possession of the ball at any given moment by selectively illuminating the arrow which points to the side of the court where that team is sitting.

Prior possession signs are typically portable, free-standing signs which are carried to the playing area and set on top of the scoring table. To maximize visibility of the sign from the court and to maximize the work area for the personnel at the table, such prior possession signs are normally located near the front edge of the table top. The electrical cord for the sign preferably feeds through an opening formed in the front portion of the table top, to an electrical outlet below the table, to keep the cord from hanging over the backedge of the table and to prevent the dangers associated therewith.

Unfortunately, use of these prior possession signs may result in injury to a player. Such signs necessarily extend above the padding on the front of the table so as to be visible from the court. As a result, if a player falls into the scoring table, even though protected from injury resulting from the corners and edges of the table by the padding, he or she may be injured by the exposed corners or edges of the prior possession sign located on the table. Moreover, the potential for injury resulting from falling into the sign may be aggravated because the free movement of the sign is limited by the electrical cord feeding through the opening in the table top. In other words, the sign will not completely "give way" if knocked by a player.

Prior possession signs, themselves, are susceptible to damage. For example, a prior possession sign may be damaged if it is dropped while being transported. And the constraint of movement of the prior sign by the electrical cord may result in stress to the cord each time the sign is pushed or jarred beyond the "free" length of the cord.

One prior scoring table includes a possession sign that is simply secured to the top of the table. The exposed edges of this add-on sign are normally covered with foam padding to reduce the risk of injury to a player. However, the sides and upper corners of the sign still protrude above the upper padded surface of the table. Thus, presenting the risk that a player who might have otherwise missed hitting the table may still hit the upwardly protruding sign, and presenting the risk that a player who is sliding along the upper padded surface of the table will bang into the upwardly protruding sign.

SUMMARY OF THE INVENTION

The general aim of the present invention is to provide a new and improved scoring table with built-in or integral bi-directional means for indicating possession of the ball during the course of a sporting event so as to eliminate the dangers associated with prior free-standing possession signs.

Another aim of the invention is to provide such means below the upper padded surface of the table so as to eliminate the dangers associated with prior possession signs that extend beyond such upper boundaries.

A detailed objective is to achieve the foregoing by providing a possession sign integral with the front section of the scoring table.

Another detailed objective is to provide an integral sign below the level of the table top.

A still more detailed objective is to provide an integral sign with translucent shapes such as arrows pointing in opposite horizontal directions and capable of being selectively illuminated.

These and other objectives and advantages of the invention will become more apparent from the following detailed description when taken in conjunction with the accompanying drawings.

Figure 1:
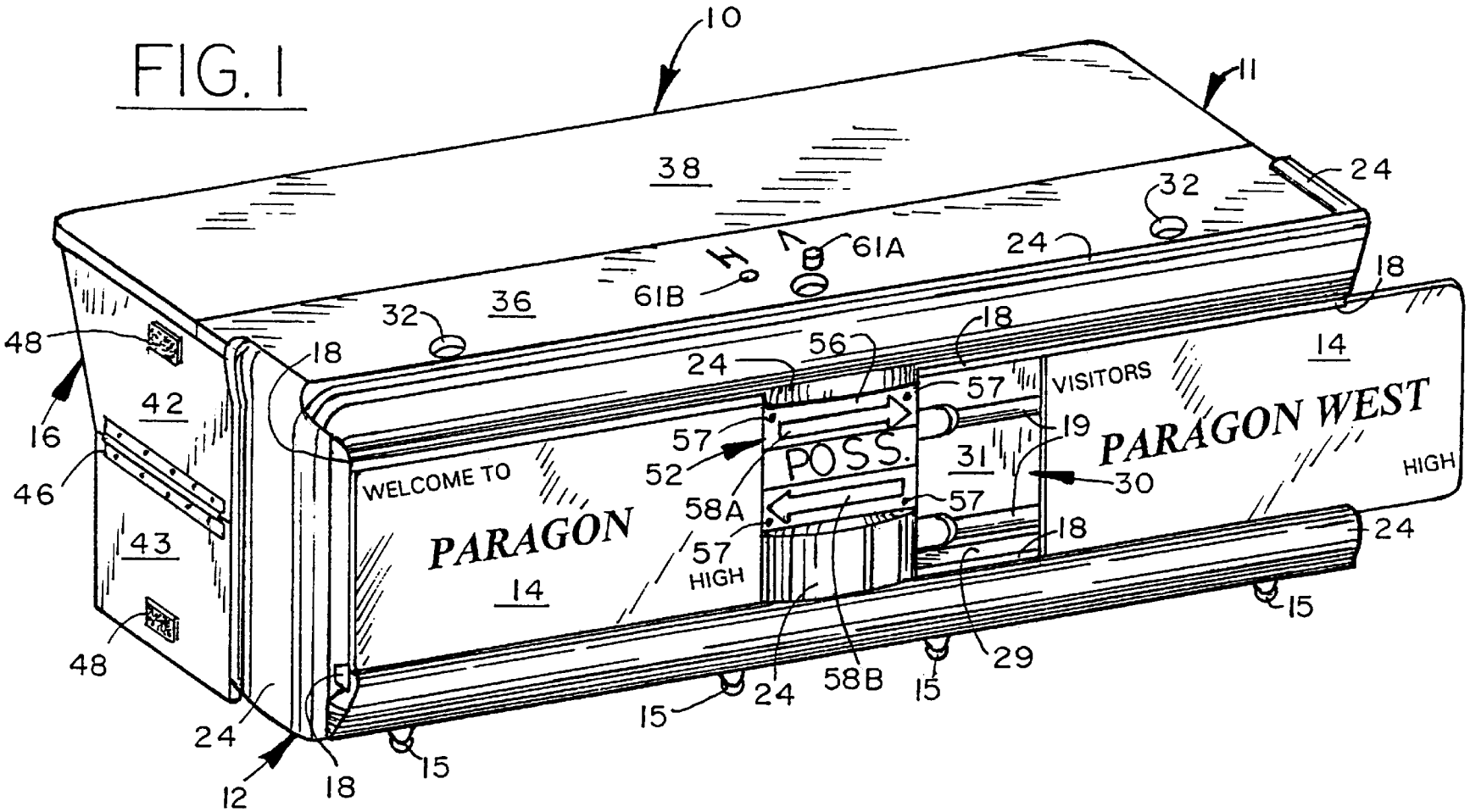
FIG. 1 is a perspective view of a new and improved scoring table incorporating the unique features of the present invention and showing the table free-standing.
Figure 2:
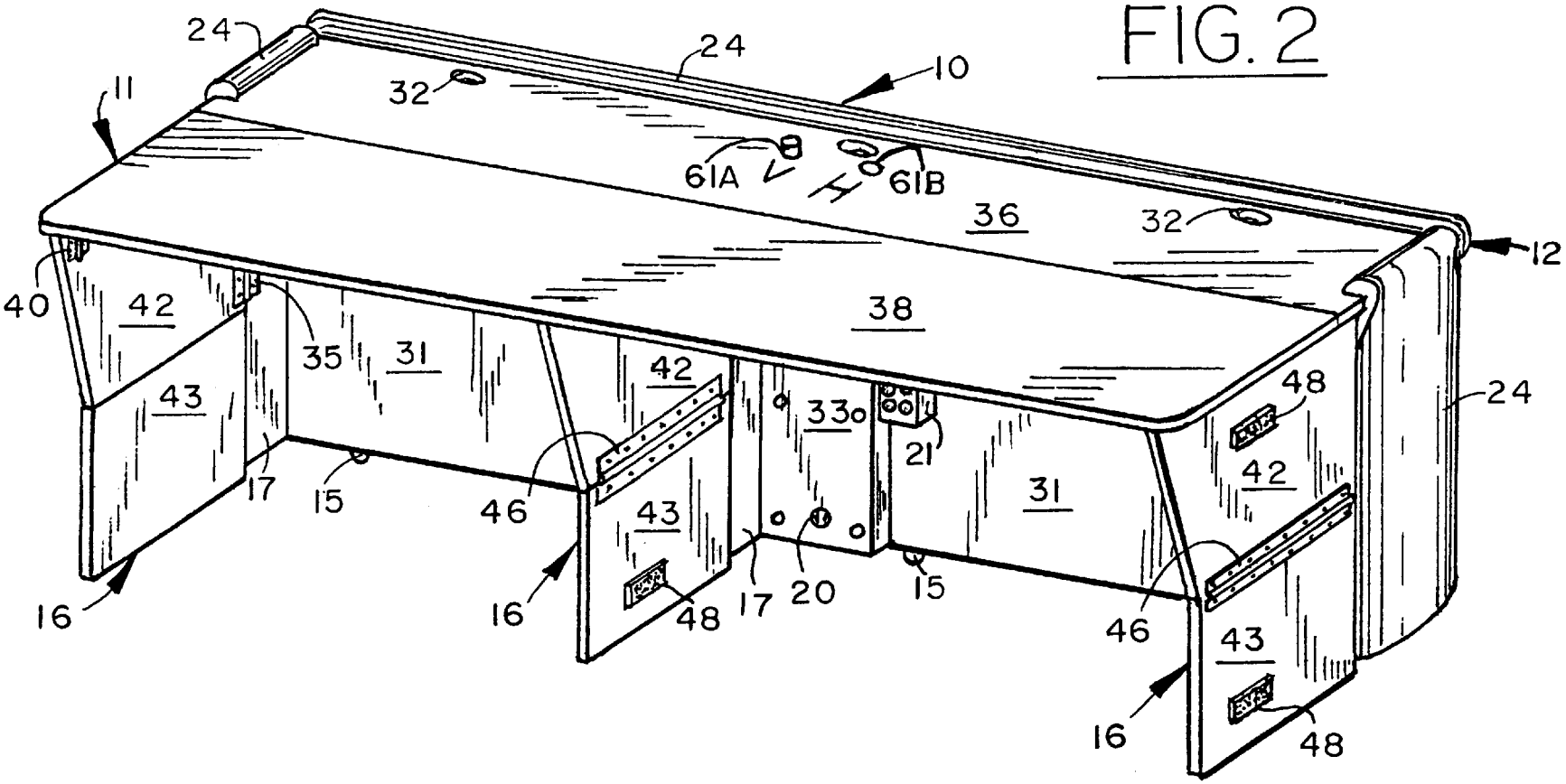
FIG. 2 is a perspective view of the back of the scoring table.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

For purposes of illustration, the present invention is shown in the drawings as embodied in a scoring table 10 (FIG. 1) adapted for use at indoor sporting events by game personnel such as time keepers, statisticians, and scorer keepers.

The scoring table 10 includes a generally horizontal table top 11, a generally vertical front section 12 adapted to carry panels 14 for displaying such things as advertising, the name of a school, or the logo of a sports team, and legs 16 adapted to support the rear portion of the table top. With this arrangement, the personnel may be seated at and work comfortably from behind the table.

The scoring table 10 shown is a collapsible table which, as further described below, is adapted for ease of mobility. To this end, the scoring table includes casters or wheels 15 pivotally mounted to the underside of the front section 12 to support the front portion of the table.

The display panels 14 are carried in tracks 18 secured to the front of the scoring table 10. The tracks are open along the outer sides for receiving the panels and are closed at the opposite and inwardly located sides to provide a stop for the panels as each panel is slid inwardly into its respective track. The outer corners of the panels are preferably rounded to reduce the likelihood of injury in the event that a panel is inadvertently knocked outwardly and extends beyond the edge of the table. The table may optionally include fluorescent lights 19 or other lighting means behind the display panels for illuminating the panels. In this instance, the panels are made from a material suitable to allow at least a portion of the light to pass through such as from translucent lexan.

An electrical extension cord (not shown) may be plugged into receptacle 20 to supply electric power to the scoring table 10. Electrical wiring 22, 63 (FIG. 5) in the table carries the power from the receptacle 20 to an electrical outlet box 21, and to, for example, the lights 19.

At many sporting events, a scoring table 10 may be located relatively close to the playing area. For example, at a basketball game, the scoring table is typically located to one side of the court, at approximately center court. A typical scoring table is approximately three to four feet wide. As a result, the forward portion of the table may be in relative close proximity to the edge of the playing court.

To protect the players from injury in the event that a player falls, bumps, or gets pushed into the edges or corners of the scoring table 10 during a game, relatively thick, vinyl-covered foam padding 24 or other suitable padding is secured to all otherwise exposed edges and corners of the forward portion of the table.

In the embodiment illustrated, the front section 12 of scoring table 10 includes a generally rectangular frame structure 25 (see FIG. 4 in which, for illustrative purposes only, the table 10 is shown without the padding 24, the panels 14, and various other components) to carry the tracks 18 and at least a substantial portion of the padding 24. The frame 25 includes opposing outer side members 17, various front members 28, and a floor member 29 (FIG. 3), the wheels being secured to the underside of the floor 29. The fluorescent lights 19 are located in enclosures 30 defined within in the frame structure. Back panels 31 close the back side of these enclosures and generally close off the back of the frame.

Openings 32 formed in the table top 11 rearwardly of the back panels 31 allow electrical cords from equipment which may be located on the table to be feed therethrough, thus enabling the cords to be plugged into the electrical outlet box 21 without having the cords dangling over the back edge of the table top.

The electrical wiring 22, 63 is preferably located generally and may optionally be located completely within the center of the front section 12 between side members 34. Advantageously, the opposing sides 34 define the inwardly located sides of enclosures 30. The wiring is accessible for maintenance through a rear access panel 33 which is pivotally or removably secured to the back of the frame structure 25 with, for example, screws along the sides of the panel.

The table top 11, frame structure 25, and legs 16 may be formed from any commonly available and suitable material such as, for example, wood, molded reinforced plastic, or sheet metal.

In the embodiment illustrated, the legs 16 and the table top 11 are adapted to fold or collapse to reduce the overall width of the scoring table 10. This enables the table to be more easily moved from place to place, such as between the court and a storage area, and reduces the space needed for storage of the table.

Figure 3:
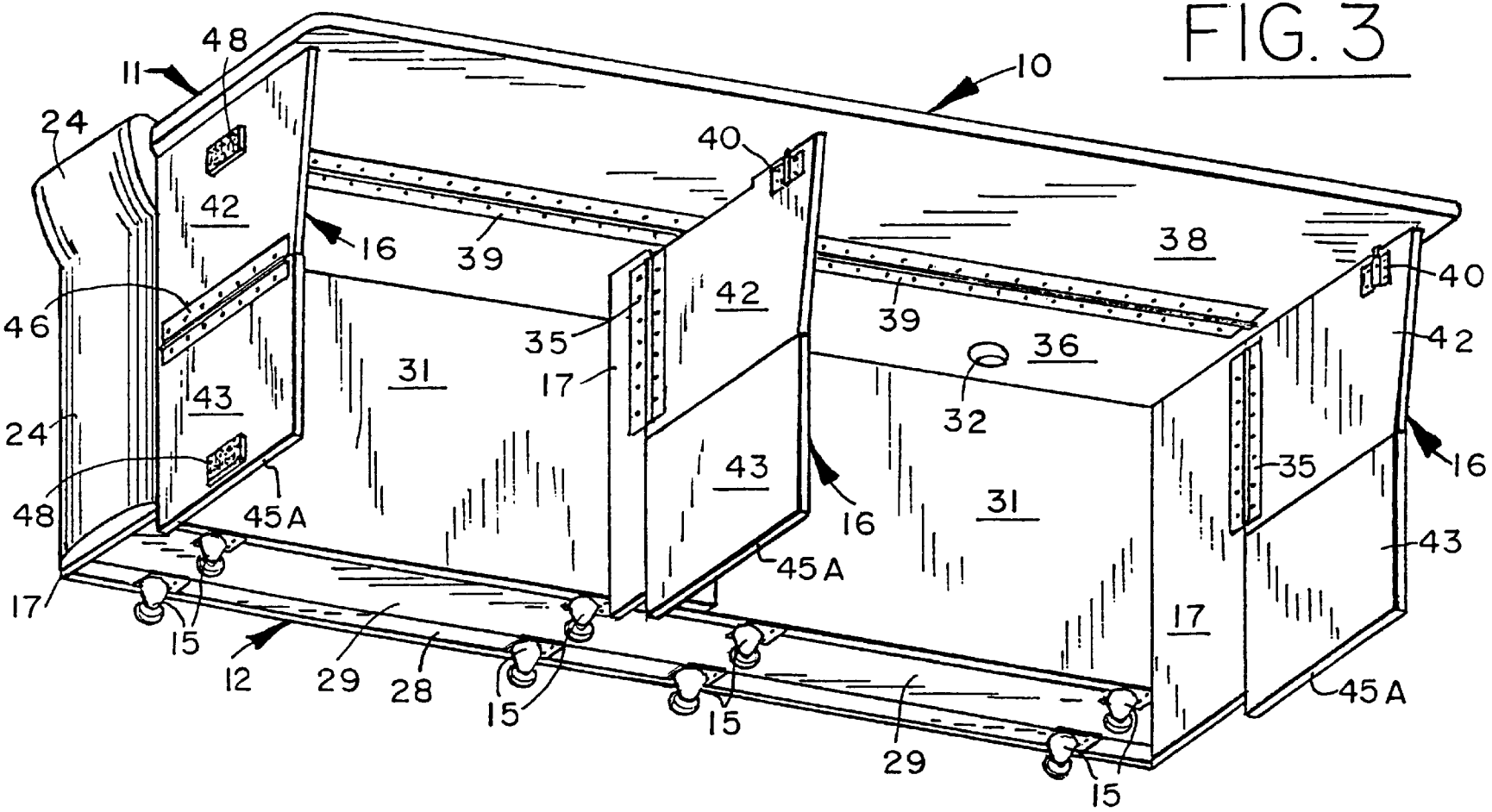
FIG. 3 is a lower perspective view of the back of the scoring table as viewed looking upwardly from the floor.
Figure 4:
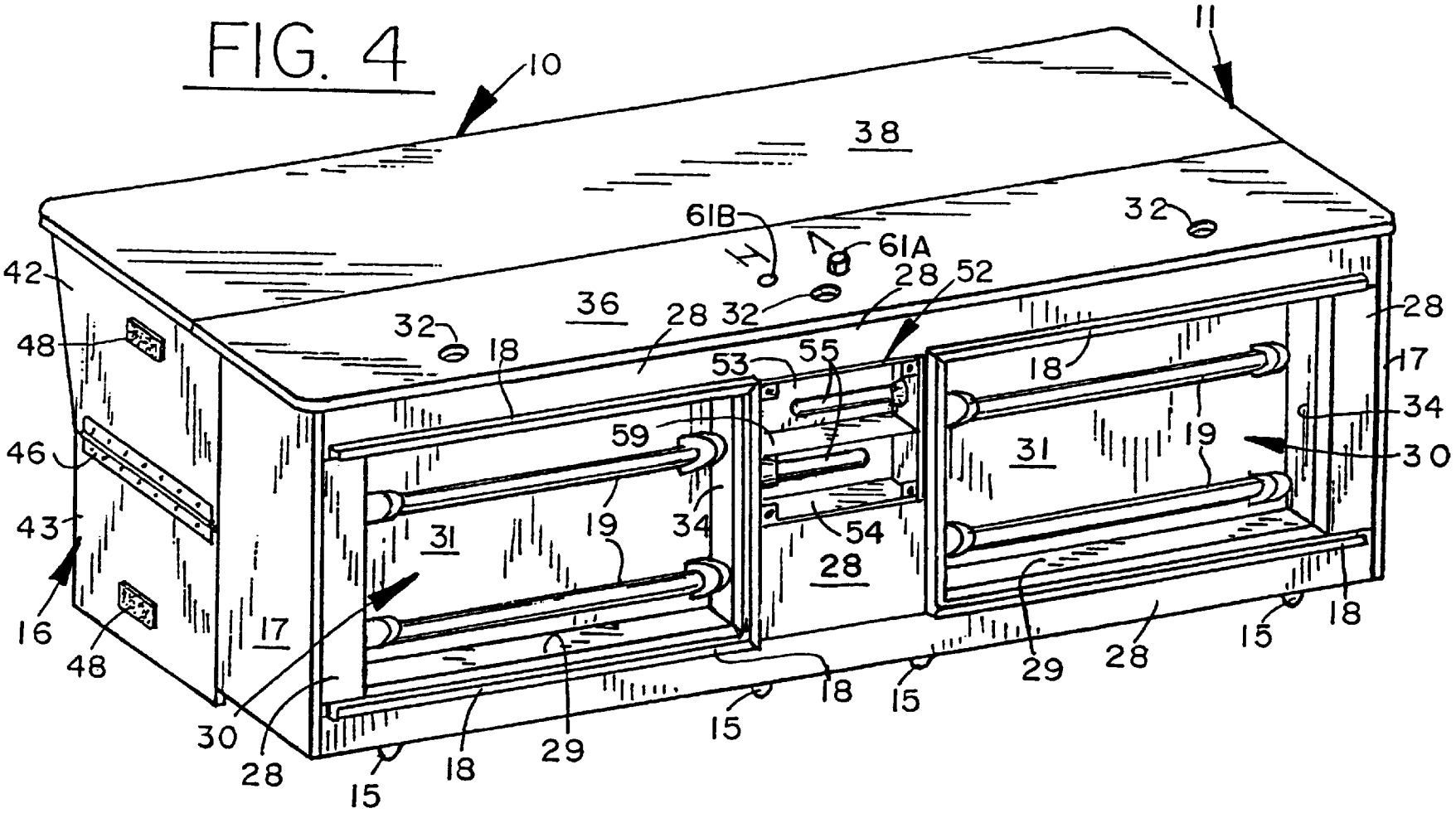
FIG. 4 is a view similar to FIG. 1 with certain parts not shown.
Figure 8:
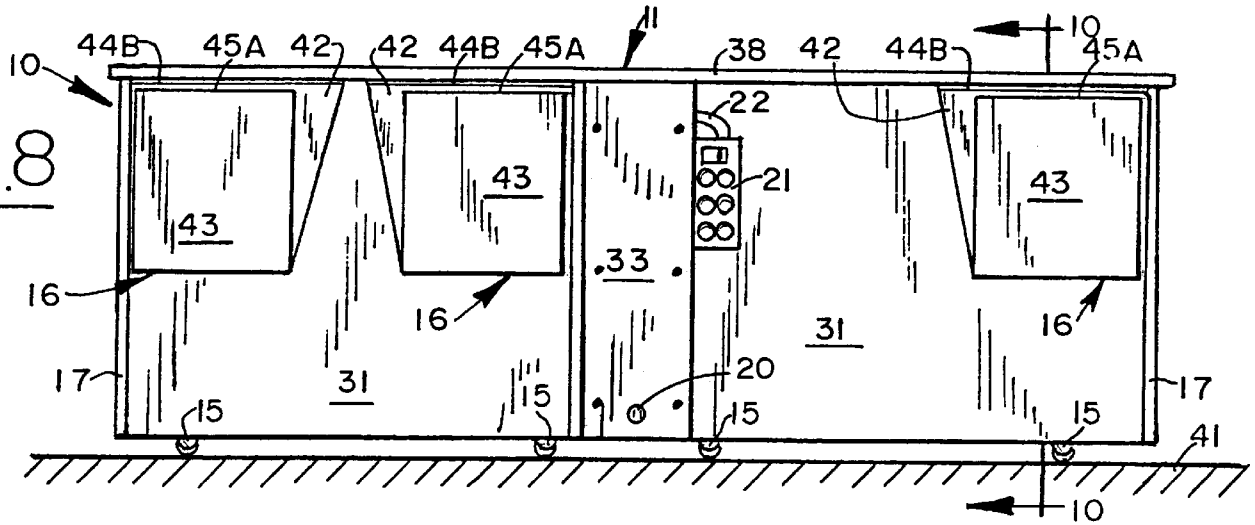
Figure 9:
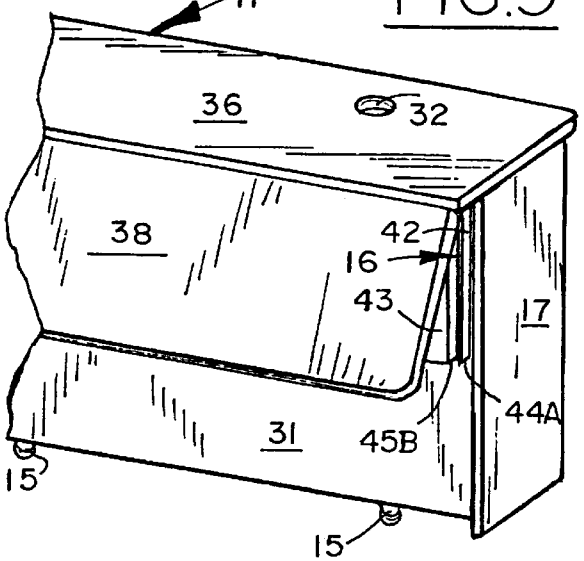
FIG. 9 is a fragmentary perspective view of the table showing the rear portion of the table top being lowered into a collapsed position after the rear legs have been folded, but with certain parts not shown.
Figure 10:
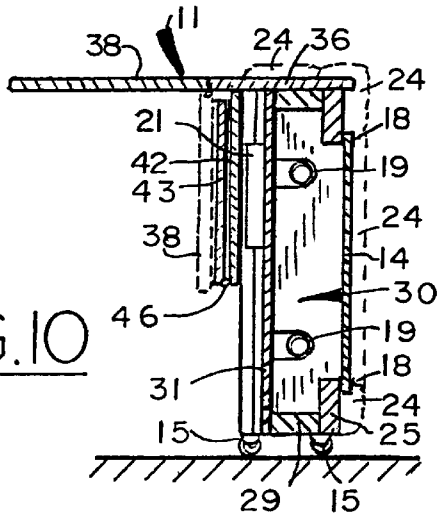
FIG. 10 is a cross-sectional view taken substantially along the line 10—10 of FIG. 8, but with certain parts not shown.

More specifically, the legs 16 are connected to the frame 25 by hinges 35 (FIG. 3). Each hinge 35 is adapted to swing through an arc of at least 90 degrees about a vertical axis for movement of the legs between (1) an operative position extending generally rearwardly from the frame as shown in FIGS. 1–4, and (2) a folded position pivoted approximately 90 degrees from the operative position and extending longitudinally along the back of the frame as shown in FIG. 8–10. The table top 11 includes a forward portion 36 secured to and generally overlying the front section 12, and a rear portion 38 which is connected to the forward portion 36 by hinge 39. The hinge 39 is adapted to swing through an arc of at least 90 degrees about a horizontal axis for positioning the rear portion 38 of the table top between (1) a horizontal working position aligned with the forward portion of the table top to create the horizontal working surface as shown in FIGS. 1–4, and (2) a folded position extending downwardly from the hinge 39 after the legs 16 have been first pivoted into their folded positions as shown in FIG. 9 and in dashed lines in FIG. 10. With this arrangement, the rear portion of the table top is supported in the working position by the legs when the legs are moved into the rearwardly extending operative position. The wheels 15 are arranged under the frame so as to support the collapsed table without the aid of the legs 16, thus providing for relative ease in relocating the table.

Locking means for securing the legs 16 in the operative position are preferably included on the scoring table 10. To this end, a sliding bolt-type lock 40, for example, may be fastened to each leg for locking the leg into position under the rear portion 38 of the table top 11 by engaging, a pre-drilled blind opening formed in the underside of the table top.

Further, in the embodiment illustrated, the scoring table 10 includes integral means for quickly and easily converting between a free-standing table and a bleacher-mounted table. To this end, each leg 16 is provided with a support member 43 that is adapted for relatively quick and easy movement between two alternate positions, the member 43 being adapted to expose a different downwardly facing or lower supporting surface of the leg 16 in each of the two positions.

Figure 7:
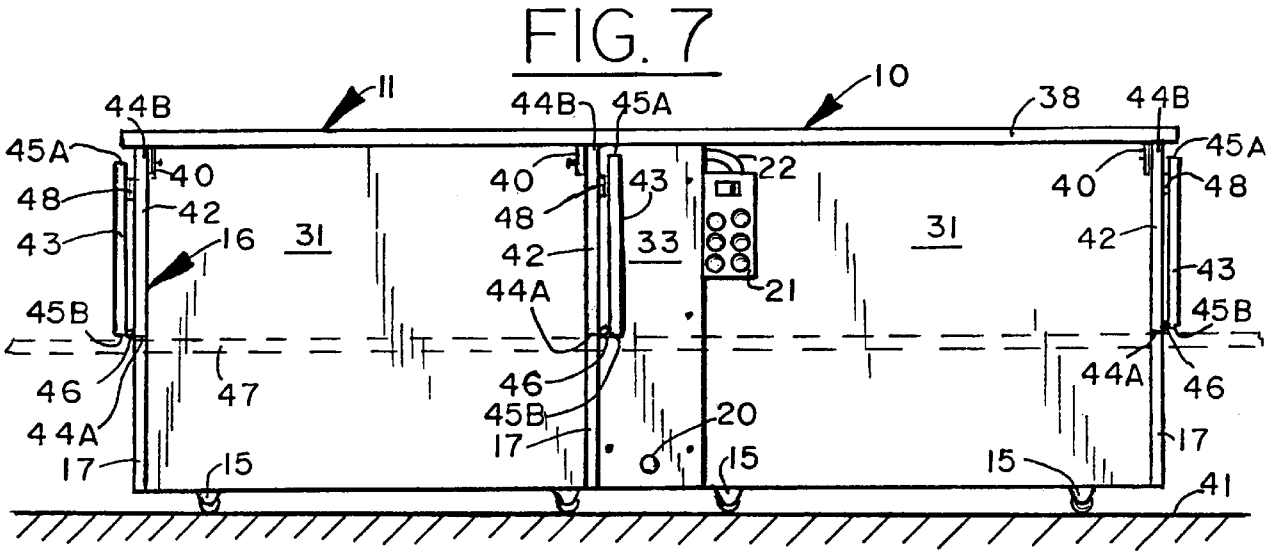
FIGS. 6–8 are rear views of the scoring table showing the steps of folding collapsible rear support legs when considered in sequence, but with certain parts not shown.
Figure 6:
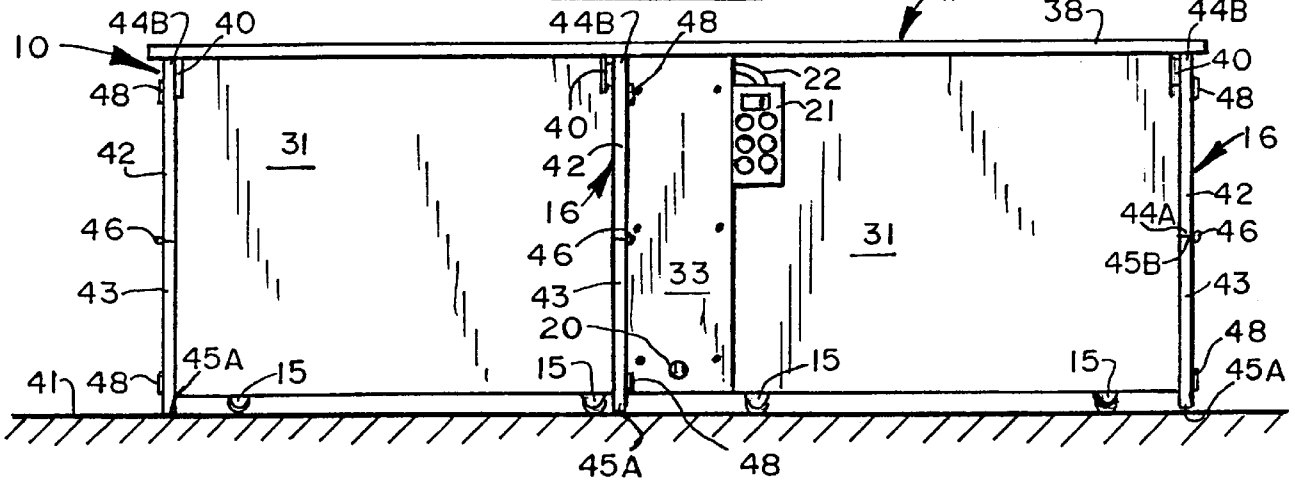

More specifically, the legs 16 are split into upper and lower leg sections or members, 42 and 43, respectively, each member having generally vertically facing edge surfaces, 44A, 44B, and 45A, 45B, respectively, (FIG. 7). The upper leg members 42 are pivotally connected to the frame 12 by the hinges 35 as discussed above, the rear portion 38 of the table top 11 resting on the upper surface 44B when the legs 16 are in the operative or supporting position. The lower leg members 43 are pivotally connected to the respective upper leg members 42 by hinges 46. The hinges 46 are adapted to swing through an arc of approximately 180 degrees about a horizontal axis for movement of each lower leg member 43 between (1) a first or "down" position aligned with and extending downwardly from the upper leg member 42 as shown in FIG. 6, and (2) a second or "up" position extending upwardly from the hinge and in proximate parallel relation to the upper leg member as shown in FIG. 7.

When the lower leg members 43 are in the down position, the edge surfaces 45A are exposed and facing downwardly for resting on and supporting the rear portion 38 of the table top 11 from a generally horizontal first surface at a predetermined height. With the lower leg members thusly positioned, the edge surfaces 45B and 44A are in face-to-face relation and not exposed or available for supporting the table.

Raising or pivoting the lower leg members 43 to the up position causes the edge surfaces 45B to rotate about the hinge 46 axis into an exposed and downwardly facing position, simultaneously exposing the downwardly facing edge surfaces 44A of the upper leg members. With the lower leg member thusly positioned, the edge surfaces 45B and especially edge surfaces 44A are available for resting on and supporting the rear portion of the table from a second generally horizontal surface at a predetermined height above the first surface. The edge surfaces 45A now face upwardly and are not available for supporting the table (see FIG. 7).

With the foregoing arrangement, the rear support legs 16 are adapted to provide alternate support surfaces 45A and 44A which may be selectively exposed for supporting the rear portion 38 of the table top 11 in a horizontal position from either of two predetermined heights. Thus, the leg members 42, 43 coact to support the table from, for example, a floor 41, when the lower leg members 43 are down. With the lower leg members up, the upper leg members 42 are adapted to support the table from, for example, a bleacher seat 47.

The steps in preparing the scoring table 10 for storage are illustrated generally in FIGS. 6 through 9. To prepare the table for storage, the lower leg members 43 are pivoted upwardly, if not already in this position from resting on a bleacher seat, 47 (see FIG. 7) and the legs 16 are then pivoted inwardly 90 degrees to the folded position (see FIG. 8). The rear portion 38 of the table top 11 is then lowered to its vertical position, adjacent but rearwardly of the folded legs as shown in FIG. 9 and in dashed lines in FIG. 10. Setting up the table after it has been relocated or removed from storage simply requires raising the rear portion of the table top to a horizontal position and then pivoting the legs outwardly and optionally lowering the lower leg members to support the rear portion of the table top from the desired surface.

In the embodiment illustrated, the edge surfaces 44A of upper leg members 42 are straight and generally horizontal for resting on a flat, for example, bleacher seat when the lower leg members 43 are up. However these edge surfaces 44A may also be formed with a predefined profile adapted to compliment, for example, a seat which has been formed with a predefined curvature. In this instance, the hinges 46 are positioned so that when the lower leg members have been pivoted to the up position, the edge members 45B swing "out of the way" to fully expose the edge surfaces 44A for supporting the table.

Provisions are also included in the scoring table 10 for selectively maintaining the lower leg members 43 in either the up or down positions. Preferably, the lower leg members are maintained in the down position by virtue of the weight of the table top 11 resting on the legs 16, and may be maintained in the up position by, for example, complimentary Velcro patches 48 secured to the upper and lower leg members 43, by or any other suitable and preferably quick-release fastening means.

In accordance with the present invention, the scoring table 10 includes built-in or integral means for indicating possession of a ball during the course of a sporting event. More specifically, a manually operable bi-directional indicating sign 52 is located within the front section 12 of the table, below the upper padded surface extending along the length of the table, and preferably below the table top 11. As a result, the team having possession of the ball may be indicated at any given time from the scoring table without the need for a free-standing sign and without presenting an additional risk of injury to the players in the event that a player falls into the table.

Figure 11:
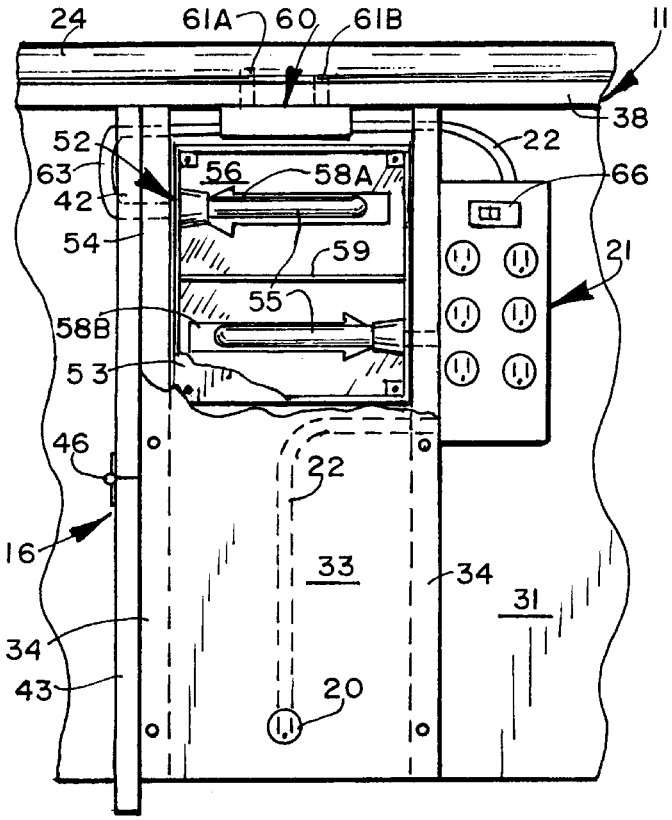
FIG. 11 is an enlarged fragmentary view of a portion of the table with an access panel cut-away and showing certain parts in detail.

In carrying out one embodiment of the invention, the built-in possession sign 52 includes an enclosure 54 in the front section 12 having a forwardly facing opening, a back panel 53 (FIG. 4), at least two independently operable lights 55 (FIG. 11) housed within the enclosure 54, and a cover panel 56 made from, for example, translucent lexan and sized to cover the forward opening of the enclosure 54. The panel 56 is removably secured to either the front of the enclosure 54 or to the front section 12 of the table by, for example, screws 57 to enable the lights 55 to be changed.

The cover panel 56 includes two translucent arrows 58A and 58B pointing generally horizontally and in opposite directions, an opaque and contrasting background, and the letters "POSS" or "POSSESSION" visible between the arrows. Each of the lights 55 is located behind one of the arrows for selectively illuminating that arrow. The lights are preferably oriented to extend over at least the arrowhead portion of the arrow. An optional divider shelf 59 aids in preventing light from "leaking" from one side of the enclosure 54 to the other side when one of the lights 55 is on. Alternately, the possession sign 52 may be equipped with two optional dividers (not shown) and a third light located behind translucent letters "POSS" or "POSSESSION" for continuous illumination of the letters. As is apparent, the enclosures for each light 55, defined in part by the divider 59 need not be physically connected as in the embodiment shown.

A manually operable switch 60 is located in the scoring table 10 at a convenient position for operation by a person sitting at the table, and is operatively connected to the lights 55 to enable that person to selectively illuminate either one or the other arrows 58A, 58B by switching off and on the respective lights 55. The switch may be of any suitable type such as a two position toggle switch, or a three position switch with the center position turning both lights off, and is preferably connected to the table top and positioned so as to not extend beyond the boundaries of the padding 24 on the table.

Figure 12:
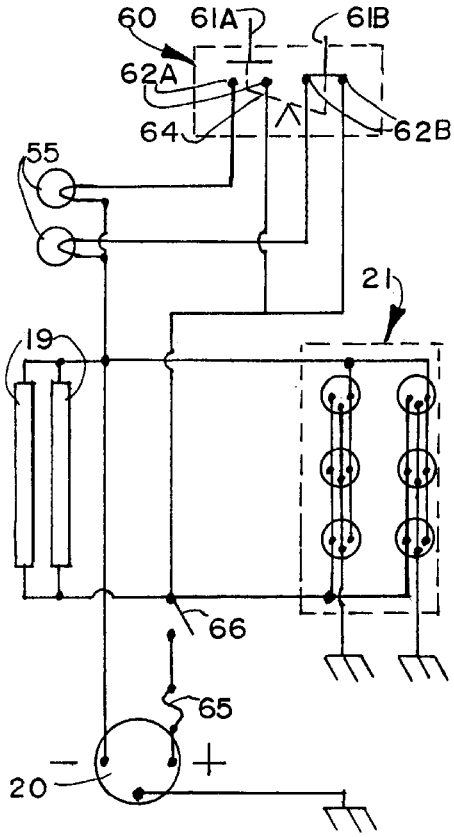
FIG. 12 is an electrical schematic for one embodiment of the scoring table.

In the embodiment illustrated, a manually operated button-type switch 60 is secured to the center of the table top 11. The button switch is a low profile switch, the upper surface of the switch being below the surface of the padding 24 along the upper front edge of the table top. The switch is wired to the two lights 55 such as is shown in the circuit of FIG. 12. Assuming power is supplied at the receptacle 20, pressing down on the left button 61A (as shown) causes the contacts 62A of that side of the switch to close and causes the contacts 62B in the right side of the switch to open. As a result, the arrow 58A pointing to the left is illuminated. Pressing the right button 61B down closes the right set of contacts 62B, illuminating the associated light 55 and arrow 58B pointing to the right. Simultaneously, connecting member 64 pivots to raise the left button, open the left switch contacts, and turn off the light behind the arrow 48A pointing to the left. The circuit shown also provides for an optional protective fuse 65 and switch 66 for selectively disabling the control circuit of the possession sign or the entire scoring table 10.

Figure 5:
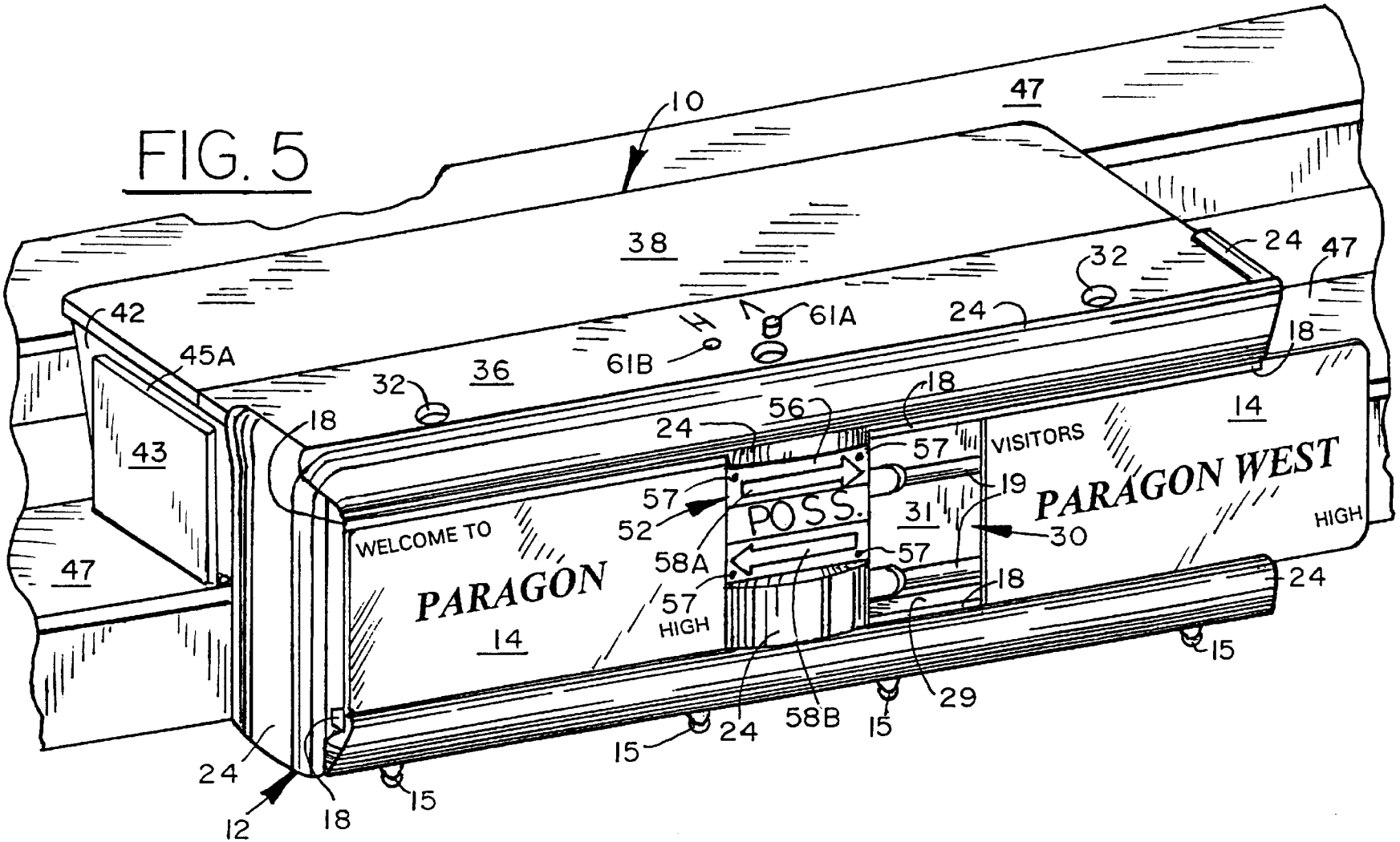
FIG. 5 is a view similar to FIG. 1 but showing the table bleacher-mounted.

With the scoring table 10 positioned between the seating areas of two teams and thus open and obvious identifying indicia of the teams such as at, a basketball game, possession of the ball is indicated by illuminating the arrow 58A or 58B which points to the side of the respective team. Alternately, if the scoring table is not positioned between the teams, each of the panels 14, for example, might display the name or logo of each of the teams as shown in FIGS. 1 and 5. In this way, the selectively illuminated arrow will point to the panel with the name or logo of the team having possession of the ball. The buttons 61A, 61B may be optionally labeled with indicia of the respective team such as the team names or "V" for visitors and "H" for the home team.

As will be apparent, visual bi-directional indicating means other than arrows may be used in the possession sign 52 to selectively indicate the desired team. For example, translucent shapes such as simple arrow heads pointing in opposite directions may be used. Alternately, two laterally spaced, for example, circular shapes which can be selectively illuminated and which are located in close proximity to identifying indicia of the respective teams such as on the panels 14 may also be used to indicate possession of the ball.

In an alternate embodiment (not shown), the front section 12 of the scoring table 10 may extend above and along the entire length of the table top 11, and the built-in possession sign 52 may optionally extend above the table top but remaining within the front section 12. In this instance, the upper padded surface 24 extending along the length of the front section extends along a single upper horizontal plane. Advantageously, this alternate table provides for a built-in possession sign which may optionally extend at least partially above the table top, whose sides and corners do not project upwardly from the front of the table, and which thus eliminates the dangers of prior upwardly projecting add-on possession signs.

Moreover, in the embodiment illustrated, the possession sign 52 is located between two panels 14 at the center of the scoring table 10. Alternately, the front section 12 may be adapted so that the possession sign is positioned, for example, at the side of the table. This alternate embodiment is particularly useful for a scoring table which includes only one panel 14.

From the forgoing, it will be apparent that the present invention brings to the art a new and improved scoring table 10 having an integral possession sign 52 which eliminates the need to find storage room for a free-standing sign, eliminates the need to carry such signs to the scoring table, and eliminates the dangers associated with prior free-standing possession signs and prior possession signs that protrude above the upper padded surface of the front section 12 of the table.

I claim:

1. A scoring table for use at sporting events comprising:

a table top comprising a rear portion pivotally connected for movement between a generally horizontal working position and a downwardly extending folded position;

a frame connected relative to the table top and having opposing sides;

means for selectively supporting said rear portion in said working position; and means for selectively indicating one of two alternate and generally horizontal directions;

said indicating means including two arrow means pointing in opposite directions, means for illuminating each of said arrow means, and manually operable switch means operatively connected to said illuminating means for illuminating said arrow means mutually exclusive of one another;

said arrow means and said illuminating means being located between said opposing sides and below a horizontal plane established through said table top.

2. A scoring table as defined in claim 1 in which said switch means is secured to said table top.

3. A scoring table as defined in claim 1 further comprising a panel connected to said frame, said arrow means being translucent and defined on said panel, and said illuminating means being located behind said panel.

4. A scoring table as defined in claim 3 in which said frame is formed with a forwardly facing opening and in which said panel is adapted to cover said opening.

5. A scoring table as defined in claim 1 in which said arrow means and said illuminating means are located within vertical planes extending through the sides of the table top.

6. A scoring table as defined in claim 1 in which said supporting means includes leg means pivotally connected relative to said table top for selectively supporting said rear portion in said working position.

7. A scoring table as defined in claim 6 in which said rear portion is spaced rearwardly from said frame when in said folded position to define a storage space therebetween, and said leg means is pivotally connected to said frame for swinging about a substantially vertical axis between (i) a generally rearwardly extending operative position under said rear portion for supporting said rear portion in said working position and (ii) a laterally extending storage position in said storage space so as to allow movement of said rear portion into said folded position.

8. A scoring table for use at sporting events comprising:

a table top comprising a rear portion pivotally connected for movement between a generally horizontal working position and a downwardly extending folded position;

a frame connected and extending along the length of said table top, one of said frame or said table top establishing an upper horizontal plane extending therethrough;

means for selectively supporting said rear portion in said working position; and means for selectively indicating one of two alternate and generally horizontal directions;

said indicating means including two arrow means pointing in opposite directions, means for illuminating each of said arrow means, and manually operable switch means operatively connected to said illuminating means for illuminating said arrow means mutually exclusive of one another;

said arrow means and said illuminating means being located within said frame and below said horizontal plane.

9. A scoring table as defined in claim 8 in which said table top establishes said horizontal plain.

10. A scoring table as defined in claim 8 in which said arrow means includes a panel formed with translucent arrows and said illuminating means is located behind said panel.

11. A scoring table as defined in claim 10 in which said frame is formed with a forwardly facing opening and in which said panel is adapted to cover said opening.

12. A scoring table as defined in claim 8 in which said supporting means includes leg means pivotally connected relative to said table top for selectively supporting said rear portion in said working position.

13. A scoring table as defined in claim 12 in which said rear portion is spaced rearwardly from said frame when in said folded position to define a storage space therebetween, and said leg means is pivotally connected to said frame for swinging about a substantially vertical axis between (i) a generally rearwardly extending operative position under said rear portion for supporting said rear portion in said working position and (ii) a laterally extending storage position in said storage space so as to allow movement of said rear portion into said folded position.

14. A scoring table for use at sporting events involving two teams and changing possession of a ball between the teams, said table comprising:

a table top comprising a rear portion pivotally connected for movement between a generally horizontal working position and a downwardly extending folded position;

a frame connected to said table top and extending along the length of said table top, one of said frame or said table top establishing an upper horizontal plane extending therethrough;

means for selectively supporting said rear portion in said working position;

spaced indicia of the two teams fixed relative to the frame; and means for selectively indicating either one or the other of said indicia so as to indicate possession of the ball by the team associated with that indicia;

said indicating means including two spaced illumination means, each of said illumination means being associated with one of said indicia, respectively, and manually operable switch means operatively associated with said illumination means for selectively illuminating either one or the other of said illumination means mutually exclusive of one another;

said illumination means being located within said frame and below said horizontal plane.

15. A scoring table as defined in claim 14 in which said illumination means are proximate to said indicia.

16. A scoring table as defined in claim 14 in which said illumination means includes two generally horizontal arrow means pointing in opposite directions.

17. A scoring table as defined in claim 14 in which said table top establishes said plane.

18. A scoring table as defined in claim 14 in which said supporting means includes leg means pivotally connected relative to said table top for selectively supporting said rear portion in said working position.

19. A scoring table as defined in claim 6 in which said rear portion is spaced rearwardly from said frame when in said folded position to define a storage space therebetween, and said leg means is pivotally connected to said frame for swinging about a substantially vertical axis between (i) a generally rearwardly extending operative position under said rear portion for supporting said rear portion in said working position and (ii) a laterally extending storage position in said storage space so as to allow movement of said rear portion into said folded position.

20. A scoring table for use at sporting events involving two teams and changing possession of a ball between the teams, said table comprising:

a table top comprising a rear portion pivotally connected for movement between a generally horizontal working position and a downwardly extending folded position;

a frame for supporting the table top, said frame including vertical wall means extending downwardly from the table top;

means for selectively supporting said rear portion in said working position;

enclosure means connected to one of said table top and said frame, said enclosure means being located to the side of said wall means and below a horizontal plane passing through the table top;

spaced indicia of the two teams fixed relative to the frame; and means for selectively indicating either one or the other of said indicia so as to indicate possession of the ball by the team associated with that indicia;

said indicating means including two spaced illumination means located in said enclosure means, each of said illumination means being associated with one of said indicia, respectively, and manually operable switch means operatively associated with said illumination means for selectively illuminating either one or the other of said illumination means mutually exclusive of one another.

* * * * *